United States Patent [19]

Gorton

[11] 4,177,540

[45] Dec. 11, 1979

[54] SELF-CLOSING CONCEALED HINGE

[75] Inventor: Howard B. Gorton, San Gabriel, Calif.

[73] Assignee: Ajax Hardware Corporation, City of Industry, Calif.

[21] Appl. No.: 876,616

[22] Filed: Feb. 10, 1978

[51] Int. Cl.[2] ..... E05D 11/08; E05F 1/12

[52] U.S. Cl. ..... 16/142; 16/180; 16/191; 49/386; 49/398

[58] Field of Search ..... 49/386, 398, 402, 399; 16/142, 180, 147, 191, 158, 159

[56] References Cited

U.S. PATENT DOCUMENTS

| | | | |
|---|---|---|---|
| 2,133,663 | 10/1938 | Johnson et al. | 16/191 X |
| 2,948,015 | 8/1960 | Hansen | 16/191 X |
| 3,381,332 | 5/1968 | Jerila et al. | 16/142 X |
| 3,602,942 | 9/1971 | Neff et al. | 16/191 |
| 3,835,585 | 9/1974 | Anderson et al. | 49/398 |
| 3,851,354 | 12/1974 | Anderson | 16/142 X |
| 3,950,818 | 4/1976 | Holmes | 16/142 X |

*Primary Examiner*—Philip C. Kannan
*Attorney, Agent, or Firm*—Dallett Hoopes

[57] ABSTRACT

Concealed self-closing door hinge has pressure element operating in a slender box-like housing comprising parallel ears which closely juxtapose the sidewalls of the slot in which the hinge operates. This gives additional support to the door. Various means for restricting the lateral movement of the pressure element are disclosed.

8 Claims, 12 Drawing Figures

-F-
-D-
2
2
52
12
22a
18
24
16
20
26
26a
22
18
S2
R
S1
50
10
36
38
40
46
42
44
30
32
28
34
30
48
14
38
36
F
F
20
24
22
22a
12
26
52
10
26a
42
28
50
36
44
40
46
32
34
48
R
D
20
24
22
22a
40
44
46
36
48
34
28
26
50
D
32
26a
42
R
-36-
40
28a
-36-
28
-42-
30
52
32
28
-36-
40
56
58
-36-
28
-42-
28
56
30
52
32
-36-
56
28
-36-
54
54
-42-
-28-
30
52
32
22
62a
46
44
40
48
34
26
52
32
26a
42
60
62

Fig. 8.
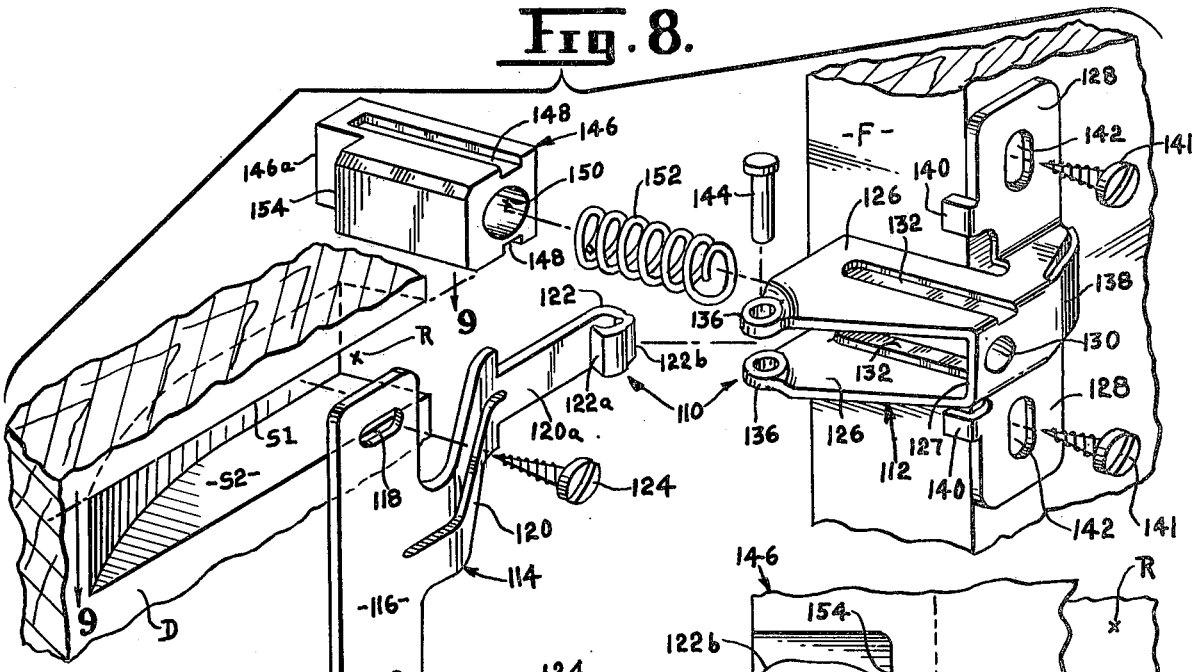
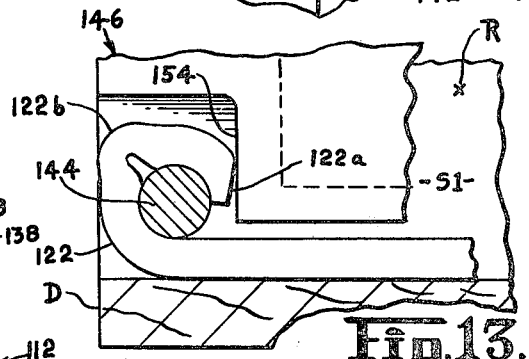
Fig. 13.
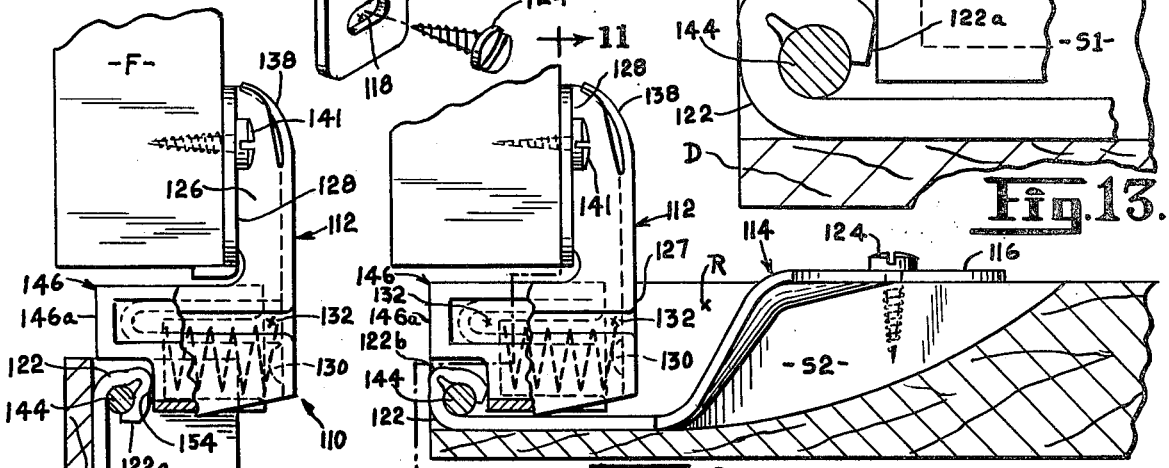
Fig. 9.
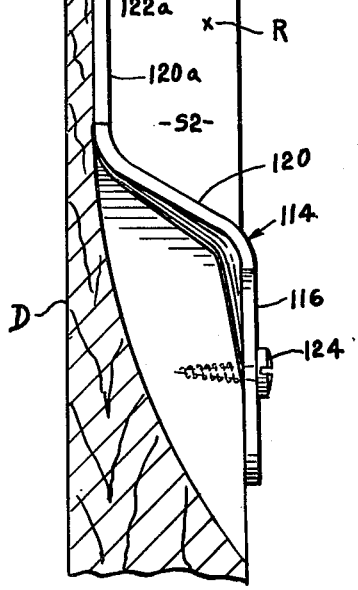
Fig. 10.
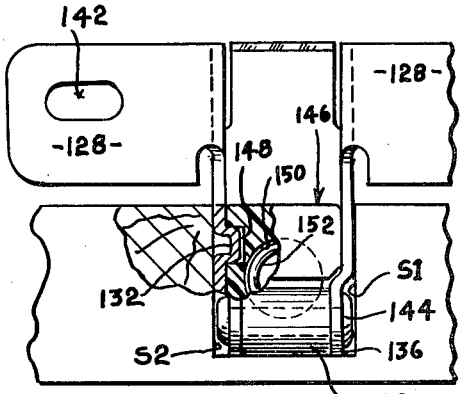
Fig. 11.
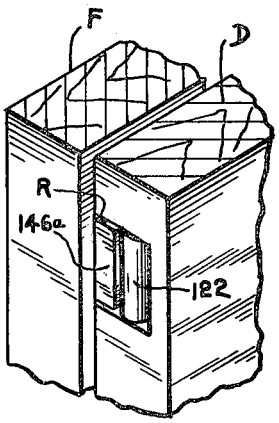
Fig. 12.

SELF-CLOSING CONCEALED HINGE

BACKGROUND OF THE INVENTION

1. Field of the Invention

This invention relates to a self-closing hinge. More particularly, this invention relates to a self-closing hinge of the concealed type which may be installed between the frame and wooden door of a cabinet such as a kitchen cabinet.

2. Description of the Prior Art

The prior art includes U.S. Pat. No. 3,835,585, granted Sept. 17, 1974 to Anderson. This patent discloses a concealed self-closing hinge of the type in which a spring-pressed element engages an edge of the hinge knuckle to urge the cabinet door toward the closed position.

A drawback of some prior devices is that they have required voluminous recesses in the rear surface of the door and have not afforded sufficient support to the door. The hinges, in other words, have been disposed in recesses in the door so ample that the doors have readily worked loose and exhibited considerable play.

SUMMARY OF THE INVENTION

Under the present invention, one of the hinge wings is provided with a slender box-like structure which fits snugly into a narrow slot or channel in the rear face of the door, the box being closely juxtaposed by the opposite sidewalls of the slot and, being equipped with lateral support plates. There is thus afforded a rigid attachment to the door not exhibited in earlier concealed self-closing hinges.

BRIEF DESCRIPTION OF THE DRAWINGS

Other features of the invention will be understood from reference to the following specification and the drawings, all of which disclose a non-limiting form of the invention. In the drawings:

FIG. 8 is a fragmentary exploded view of a modified form of hinge embodying the invention;

FIG. 9 is a top view of the assembly with the door in section as assembled and installed and showing the door in closed condition with portions of the frame wing housing broken away;

FIG. 10 is similar to FIG. 9 but shows the door in open condition;

FIG. 11 is an end view with portions taken on the line 11—11 of FIG. 9;

FIG. 12 is a fragmentary perspective view of the end of a door assembly embodying the invention; and FIG. 13 is a greatly enlarged view showing the form of a hinge knuckle otherwise disclosed in smaller scale in FIG. 9.

DESCRIPTION OF THE PREFERRED EMBODIMENTS

Figures 1, 2, 3, 4, 5, 6, 7:
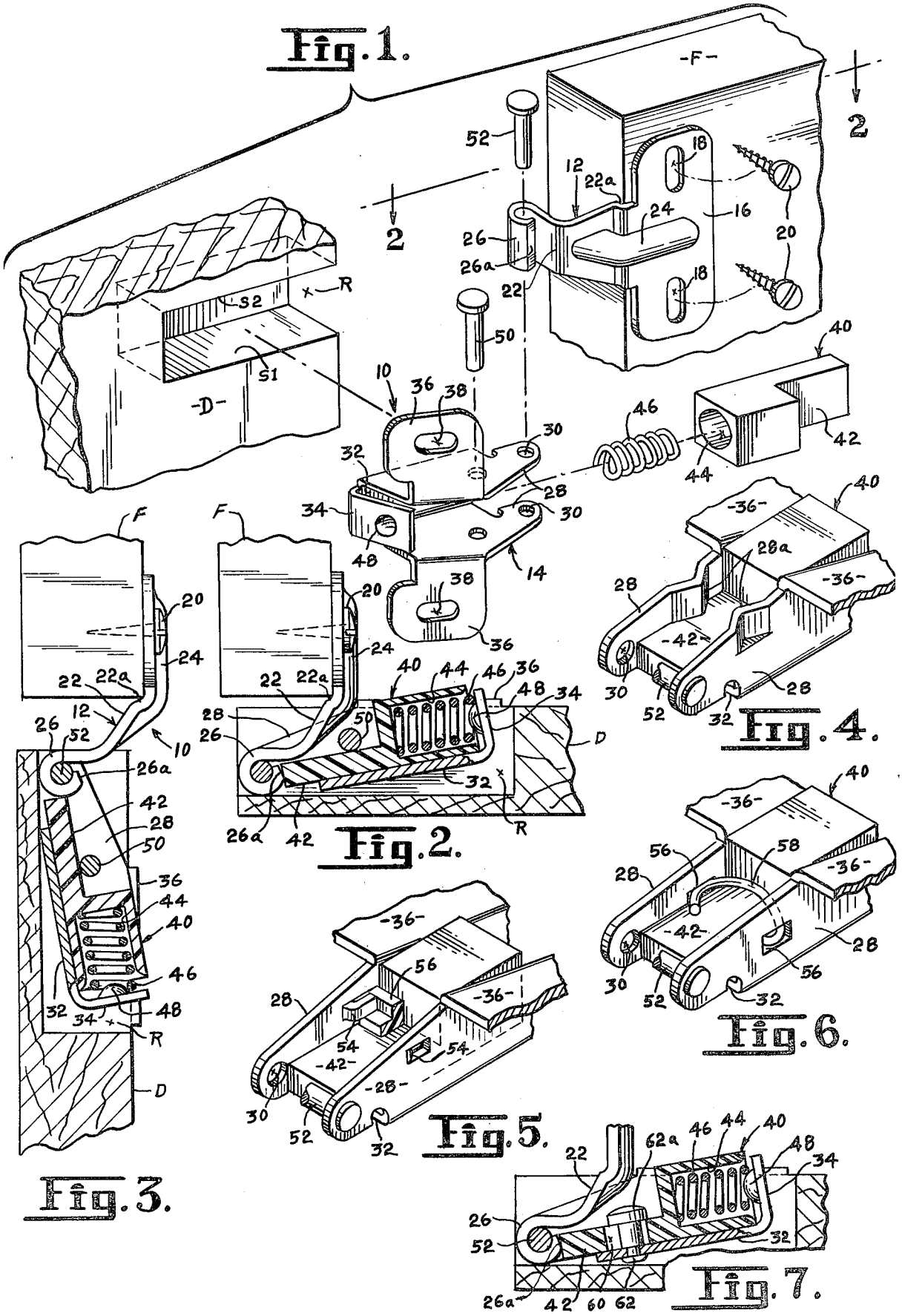
FIG. 1 is an exploded perspective view of a hinge embodying the invention installed on a door and frame.
FIG. 2 is a sectional view taken on the line 2—2 of FIG. 1 and showing the door in the closed position.
FIG. 3 is a sectional view similar to FIG. 2 but showing the door in the open condition.
FIGS. 4, 5, 6, and 7 are fragmentary perspective views of a hinge embodying the invention and having modified forms of pressure element retainer.

Referring more specifically to the drawings, an embodiment of the invention is disclosed in exploded perspective view in FIG. 1 in which the hinge is generally designated 10. As shown, the hinge has two wings 12 and 14 which are secured respectively to the cabinet frame F and the door D.

The frame wing 12 comprises a support plate 16 which is formed with elongated aligned apertures 18 through which screws 20 may be driven into the frame. Centrally of the plate 16, the wing is formed with an arm 22 which is bent laterally at an edge locator point 22a (FIG. 2) and formed with a reinforcing rib 24 which flows into the plate 16. The arm 22 terminates in a knuckle 26.

As shown, the door is formed with a recess R having sidewalls S-1 and S-2.

The door wing 14 comprises a box-like structure including a pair of ears 28 having aligned apertures 30. The ears are joined by a bight section 32, and an end tab 34 is also provided. The door wing is formed with a pair of laterally extending securing strips 36 which are also apertured as at 38 to receive screws (not shown) for attachment to the door. In installation, the box-like structure comprising the ears 28, the bight 32, and the closing end tab 34 fits snugly into the recess R with the ears touching or closely juxtaposing the sidewalls S-1 and S-2.

Disposed within the box-like structure defined partly by the ears 28 is a pressure element 40 which is preferably of hard plastic. It is generally a rectangular solid but includes a reduced bearing section 42 and presents an end bore 44 for receipt of a helical spring 46. The closing end tab 34 is struck with an inward nib 48. A retaining bar 50 connects the ears 28, as shown (FIG. 2) and keeps the pressure element against the bight 32.

In assembly of the hinge, of course, the ears 28 are brought up over the knuckle 26 so that the openings 30 align with the opening in the knuckle 26 and the hinge pin 52 extends through the openings and is headed at both ends to pivotally lock the two wings (FIGS. 2, 3).

Disposed between the ears 28 is the pressure element 40, the reduced section 42 of which bears against the knuckle 26 as will be described. The outer end of the spring 46 engages the tab 34 and is centered by the nib 48. The retaining bar 50 serves to hold the pressure element in the box but permits its reciprocal movement therewithin.

As shown in FIGS. 2 and 3, the operation of the hinge is quite simple. The pressure element 40, strongly biased by spring 46, has its reduced bearing section 42 working against the knuckle 26. It will be noted that the knuckle includes an edge 26a (FIG. 2). As in the prior art, when the door is brought close to the closed condition, the bearing section 42 of the pressure element engages the edge 26a and serves as a cam driver (FIG. 2) forcing the door towards closed position. Thus, no latch is needed on the door.

The versions of FIGS. 4 through 7 include substitute means for the retaining bar 50 in the versions 1 through 3. The identical reference numerals are used for corresponding parts to those parts of the FIGS. 1 through 3 embodiment.

In the FIG. 4 embodiment, the ears 28 are lanced and struck inward as at 28a to provide overhanging retainers just above the surface of the nose 42 permitting only the reciprocal movement of the pressure element between the ears.

In the FIG. 5 embodiment, spurs 54 are struck inwardly of the ears 28 and a plastic angle 56 is supported thereby bridging over section 42 as shown, to keep the element 40 against bight 32, but permitting its smooth reciprocal movement therealong.

In the FIG. 6 embodiment, windows 56 are struck in the ears 28 and a C-shaped spring element 58 is supported in the openings 56 in a plane parallel to bight 32 and against the upper face of the section 42. This permits the lengthwise reciprocation of the pressure element 40 but holds it against bight 32.

In the FIG. 7 embodiment, the section 42 is slotted as at 60 and a rivet 62, secured to bight 32, extends through the slot 60 and is formed with an enlarged heat 62*a* holding the pressure element 40 against the bight 32, at the same time permitting easy reciprocal movement.

In all of the variations of FIGS. 4 through 7, a spring comparable to the spring 46 is provided in element 40 and the operation of these variations is identical to the operation described in connection with the FIGS. 1 through 3 embodiment.

ADDITIONAL EMBODIMENT

Referring now to the embodiment in FIGS. 8 through 13, the hinge structure here is generally designated 110 and comprises a frame wing 112 and a door wing 114. The door wing comprises a lateral securing plate 116 with slotted apertures 118, and an inwardly directed arm 120 having a portion 120*a* parallel to the plate 116 and terminating in a knuckle 122.

In installation, a narrow recess R is formed in the door D and the wing 114 is placed with its arm portion 120*a* adjacent the back wall of the recess (FIG. 10), the wing being secured to the door by screws 124 through the slots 118.

The frame wing comprises the box-like body including the ears 126 disposed parallel and a connecting bight 127 formed with an inward nib 130. The ears are formed with aligned parallel inward ribs 132 and slightly inwardly offset journals having aligned openings 136.

Fanning rearwardly from the ears 126 are a pair of support plates 128 which are disposed in a plane perpendicular to the ears. From the bight 127, a closing tab 138 curves rearward, as shown. The plates 128 are formed with perpendicular locating tabs 140.

In installation, the frame wing 112 is placed at the edge of the frame F with the plates 128 disposed on the inward face of the frame and the tabs 140 disposed at the corner (FIG. 10). Screws 141 pass through vertical slots 142 and secure the frame wing to the frame.

The frame wing and door wing are pivoted together by a pin 144 which passes through the openings 136 and through the knuckle 122 inbetween.

A pressure member 146 is preferably of hard plastic and is substantially a rectangular solid having aligned grooves 148 on its opposite sides. The grooves receive the ribs 132. The inner end of the pressure element 146 is formed with a bore 150 which receives a spring 152 in compression. The opposite end of the spring is located and steadied by the nib 130 (FIG. 9).

The outer end of the pressure element 146 is formed with a forward end 146*a* (FIG. 10) which closes a portion of the end of the recess and is of cosmetic significance. The outer end is stepped as shown and presents a shoulder or bearing section 154 which bears against the knuckle 122 in a direction toward the center of the pin 144 at all times.

The knuckle 122 is formed with an edge portion 122*a*, as in the prior art, against which the shoulder 154 works as a cam driver. Thus, when the door (FIG. 13) approaches the closed position, the spring-pressed bearing section 154 works against the edge 122*a* to drive the door to its completely closed condition. This makes a door latch unnecessary. It will be noted also from FIG. 13 that the knuckle is formed with an outer bump 122*b* which serves, when the door is 90° open, to be worked on by the section 154 to constitute a stop tending to limit the further opening of the door.

In use, it will be noted that when the door is closed the ears 128 are closely juxtaposed to the sidewalls S-1 and S-2 of the recess R (FIG. 11). This gives the door additional vertical support as the broad surfaces of the ears 126 are ready to absorb any vertical knocks or stresses that the door receives.

An important feature of the invention is the provision of the flat sidewalls of the ears 28 or 126 of the various embodiments which are proximate to the sidewalls of the recess. Because the ears are parallel, the sidewalls S-1 and S-2 may be parallel and hence the narrow recess R may be formed in the door with an ordinary dado head on a conventional bench or radial saw.

Preferably, the width of the embodiment across the outside of the ears 28 or 126 is no greater than 3 times the width of the knuckle 26 or 122, respectively, or 8 times the width of the pin 52 or 144, respectively. This assures the compactness of the unit.

While the invention has been shown in but a limited number of embodiments and variations, it is susceptible of many changes and thus the protection afforded is to be limited only by the following claim language and equivalents thereof:

I claim:

1. A compact hinge assembly comprising door and frame wings mountable on said door and said frame, respectively, one of the wings having a housing including a pair of closely spaced parallel ear plates joined by a connecting bight and adapted to be concealed in a narrow elongate recess in the door, the ear plates having laterally extending securing plates, the other of the wings having a knuckle having an engageable ridge and disposed inbetween the ear plates and an arm connected to the knuckle at one end and having second securing plates at the opposite end, the arm fitting between the ear plates, a hinge pin pivotally interconnecting said knuckle and ear plates for relative swinging of said wings about a fixed axis defined by the axis of said hinge pin, a pressure element disposed in snug sliding relation between the ear plates, spring means biasing the pressure element substantially radially toward said hinge pin in all positions of said wings, and retaining means on the housing and engaging the remote side of the pressure element from the connecting bight to hold the pressure element against the connecting bight, whereby adjacent the closed position of the door the pressure element engages the ridge to urge the door to closed position.

2. A hinge assembly as claimed in claim 1 wherein the pressure element is a rectangular solid having at one end an axial bore extending from one end part way through the element and said spring means is a spiral spring disposed in compression between the inner end of the bore and a portion of the housing.

3. A hinge assembly as claimed in claim 2 wherein the other end of the pressure element is formed with a portion adapted to engage the knuckle and a projection adjacent the portion, the projection extending alongside and beyond the pin to provide an end surface adjacent the knuckle.

4. A hinge assembly as claimed in claim 2 wherein the other end of the pressure element has a reduced portion the end of which is adapted to engage the knuckle.

5. A hinge assembly as claimed in claim 4 wherein the retaining means comprises an elongate element bridging between the ear plates.

6. A hinge assembly as claimed in claim 4 wherein the retaining means are portions of the respective ear plates bent inward over the pressure element.

7. A hinge as claimed in claim 4 wherein the reduced portion is slotted therethrough longitudinally from its side adjacent the connecting bight to its remote side and the retaining means extends up from the connecting bight through the slot and has a terminal portion engaging said opposite side.

8. A compact hinge assembly comprising door and frame wings mountable on said door and said frame, respectively, one of the wings having a housing including a pair of closely spaced parallel ear plates joined by a connecting bight and adapted to be concealed in a narrow elongate recess in a door, the ear plates having laterally extending securing plates disposed in a plane perpendicular to the ear plates for mounting on the inside face of a door frame, the other of the wings having a knuckle disposed inbetween the ear plates and an arm connected to the knuckle at one end and having second securing plates at the opposite end, the arm fitting between the ear plates, a hinge pin pivotally interconnecting said knuckle and ear plates for relative swinging of said wings about a fixed axis defined by the axis of said hinge pin, a pressure element disposed in snug sliding relation between the ear plates, the pressure element having longitudinal grooves and the ear plates having tongue means interfitting with the grooves to guide and retain the element, the pressure element being a rectangular solid having at one end a bore extending from said one end part way through the element, and spiral spring means disposed in the bore in compression between the inner end of the bore and a portion of the housing and biasing the pressure element substantially radially toward said hinge pin in all positions of said wings, the knuckle having a ridge engageable by the pressure element to urge the door to closed disposition, the other end of the pressure element being formed with a portion adapted to engage the knuckle and having a projection adjacent the portion, the projection extending alongside and beyond the pin to provide an end surface adjacent the knuckle, the tongue means and grooves being offset from the knuckle and the grooves extending beyond the knuckle and into the projection.

* * * * *